US007767924B2

(12) United States Patent
Jeon et al.

(10) Patent No.: US 7,767,924 B2
(45) Date of Patent: Aug. 3, 2010

(54) ELECTROSTATIC SEPARATION SYSTEM FOR REMOVAL FOR FINE METAL FROM PLASTIC

(75) Inventors: Ho-Seok Jeon, Daejeon (KR); Shun-Myung Shin, Daejeon (KR); Byoung-Gon Kim, Daejeon (KR)

(73) Assignee: Korea Institute Of Geoscience And Mineral Resources, Daejeon (KR)

( * ) Notice: Subject to any disclaimer, the term of this patent is extended or adjusted under 35 U.S.C. 154(b) by 867 days.

(21) Appl. No.: 10/571,071

(22) PCT Filed: Sep. 8, 2004

(86) PCT No.: PCT/KR2004/002272

§ 371 (c)(1),
(2), (4) Date: Dec. 6, 2006

(87) PCT Pub. No.: WO2005/024854

PCT Pub. Date: Mar. 17, 2005

(65) Prior Publication Data

US 2007/0084757 A1 Apr. 19, 2007

(30) Foreign Application Priority Data

Sep. 9, 2003 (KR) ..... 10-2003-0063262
Sep. 9, 2003 (KR) ..... 10-2003-0063274

(51) Int. Cl.
*B03C 7/00* (2006.01)

(52) U.S. Cl. ..... 209/127.3; 209/127.1; 209/127.4; 209/129

(58) Field of Classification Search ..... 209/127.1, 209/127.3, 127.4, 129
See application file for complete search history.

(56) References Cited

U.S. PATENT DOCUMENTS

| | | | | |
|---|---|---|---|---|
| 3,720,312 | A * | 3/1973 | Shook et al. | 209/130 |
| 5,704,490 | A * | 1/1998 | Reynard | 209/128 |
| 5,845,783 | A * | 12/1998 | Smith | 209/127.4 |
| 6,390,302 | B1 * | 5/2002 | Abrarov et al. | 209/12.2 |
| 6,415,929 | B1 * | 7/2002 | Maehata et al. | 209/12.2 |
| 6,723,938 | B1 * | 4/2004 | Gates | 209/128 |
| 6,789,679 | B2 * | 9/2004 | Abrarov et al. | 209/12.2 |
| 7,041,925 | B2 * | 5/2006 | Gates | 209/127.1 |
| 2003/0132140 | A1 * | 7/2003 | Oder et al. | 209/218 |

* cited by examiner

*Primary Examiner*—Patrick Mackey
*Assistant Examiner*—Kalyanavenkateshware Kumar
(74) *Attorney, Agent, or Firm*—Venable LLP; Henry J. Daley

(57) ABSTRACT

An electrostatic separation system for separating fine metal and plastics is disclosed. An electrostatic separation system according to the present invention comprises a negative electrostatic induction plate and positive metal net made of special materials, which have appropriate dimensions and an appropriate space between them to improve separation efficiency, and a separating plate which is appropriately positioned to improve separation efficiency. The electrostatic separation system has processing capacity more than 5 times in comparison to conventional electrostatic selection systems and is able to separate fine particles of 0.1 mm in size. In addition, the electrostatic separation system has wide application in recycling other useful recourses as well as separating the mixture of fine particle metal and non-metal materials.

7 Claims, 15 Drawing Sheets

Fig. 1

| Product | Production | 1st quarter (1~3) | 2nd quarter (4~6) | 3rd quarter (7~9) | 4th quarter (10~12) | Total |
|---|---|---|---|---|---|---|
| Bare copper wire | Value (million won) | 112,745 | 46,006 | 38,871 | 48,387 | 246,009 |
| | Volume (t) | 47,363 | 17,896 | 15,805 | 19,239 | 100,303 |
| Others | Value (million won) | 114,931 | 106,831 | 125,732 | 135,648 | 483,142 |
| | Volume (t) | 5,550 | 4,326 | 5,439 | 18,816 | 34,131 |
| Rubber insulated wire | Value (million won) | 50,432 | 57,105 | 44,740 | 49,535 | 201,812 |
| | Volume (t) | 6,580 | 8,238 | 6,994 | 7,031 | 28,843 |
| Transport cable | Value (million won) | 46,545 | 46,132 | 48,071 | 50,440 | 191,188 |
| | Volume (t) | 8,083 | 9,118 | 8,263 | 10,456 | 35,920 |
| Power transmission cable | Value (million won) | 250,875 | 287,559 | 259,365 | 282,179 | 1,079,978 |
| | Volume (t) | 62,355 | 76,032 | 85,481 | 71,382 | 295,250 |
| Communication cable | Value (million won) | 63,921 | 87,506 | 79,947 | 72,026 | 303,400 |
| | Volume (t) | 10,949 | 15,480 | 13,550 | 12,023 | 52,002 |
| Optical cable | Value (million won) | 40,021 | 50,431 | 58,232 | 53,148 | 201,814 |
| | Volume (t) | 0 | 0 | 0 | 0 | 0 |
| Aluminum wire | Value (million won) | 32,779 | 31,165 | 36,513 | 22,542 | 122,999 |
| | Volume (t) | 8,382 | 10,018 | 9,983 | 5,803 | 34,186 |
| Magnet wire | Value (million won) | 71,177 | 71,778 | 60,463 | 64,257 | 267,675 |
| | Volume (t) | 19,151 | 19,937 | 17,039 | 18,316 | 74,443 |
| Cable for ships | Value (million won) | 0 | 0 | 0 | 10,446 | 10,446 |
| | Volume (t) | 0 | 0 | 0 | 941 | 941 |
| ROD | Value (million won) | 227,983 | 245,117 | 210,917 | 217,552 | 901,569 |
| | Volume (t) | 98,788 | 104,849 | 102,326 | 106,647 | 413,610 |
| Sum of production value (million won) | | 1,011,409 | 1,029,612 | 962,851 | 1,006,160 | 4,010,032 |
| Sum of production volume (t) except optical cable | | 267,201 | 265,894 | 264,880 | 271,654 | 1,069,629 |

Fig. 2 -Prior Art -
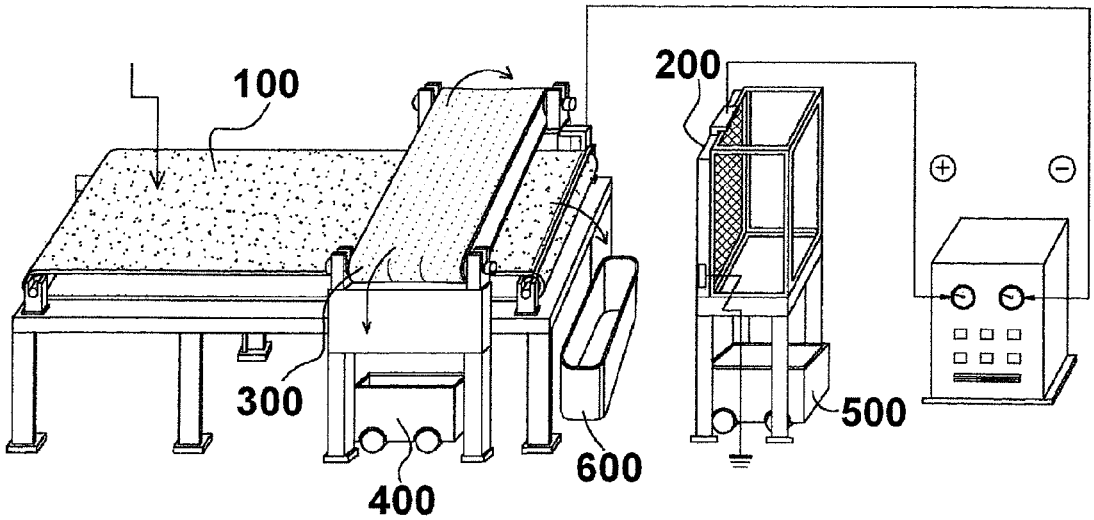
Fig. 3 - Prior Art -
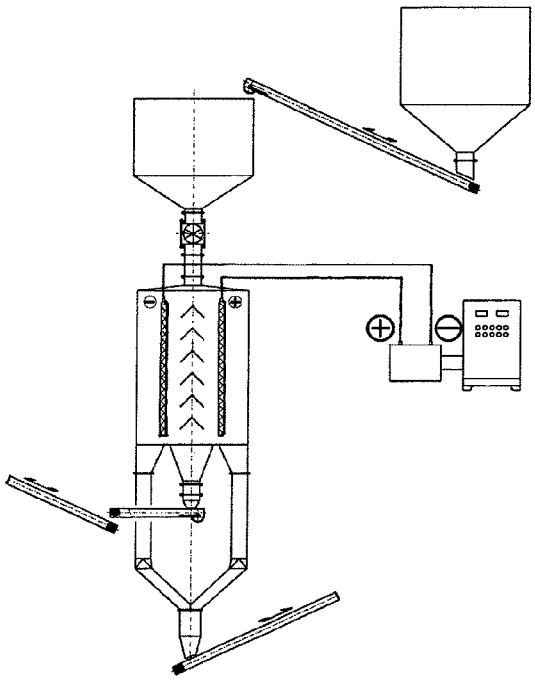

Fig. 4 - Prior Art -
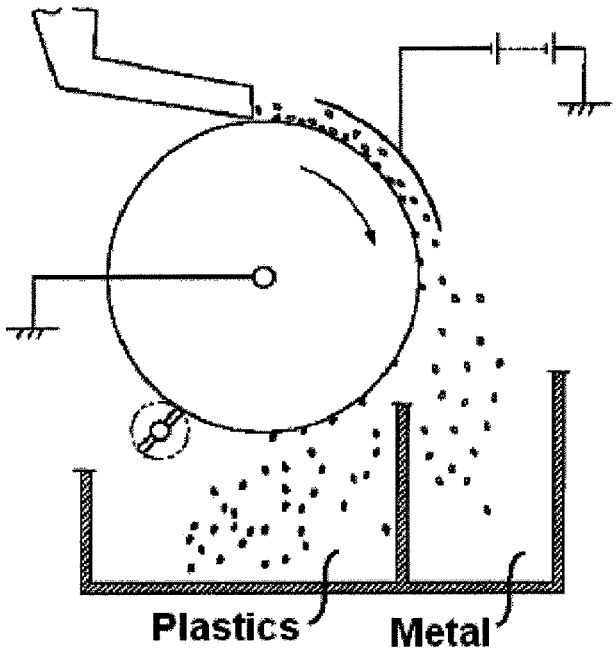

Fig. 5 - Prior Art -
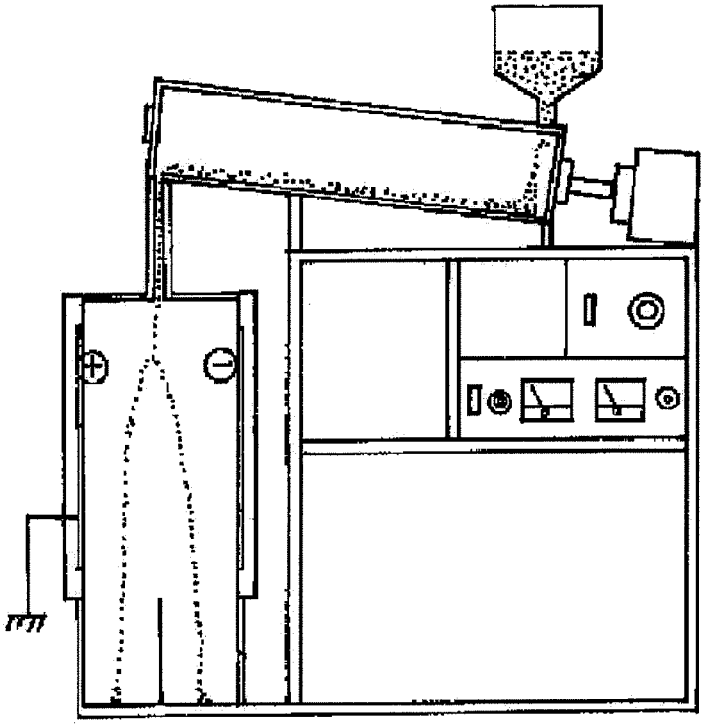
Fig. 6
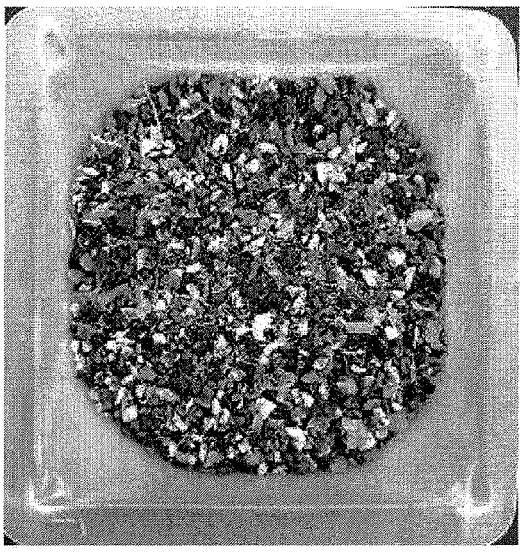

STAINLESS MATERIAL COPPER MATERIAL

ELECTROSTATIC SEPARATION SYSTEM FOR REMOVAL FOR FINE METAL FROM PLASTIC

TECHNICAL FIELD

The present invention relates to electrostatic separation systems to separate plastics and particulate non-ferrous metals and, more particularly, to an electrostatic separation system comprising an electrostatic induction plate (negative electrode), a metal net (positive electrode), and a separating plate. The electrostatic induction plate and the metal net have respectively appropriate size and are a predetermined distance apart to improve separation efficiency. According to the capacitance of the two electrodes, the separating plate is appropriately apart from the electrostatic induction plate and the metal net to raise the separation efficiency.

BACKGROUND ART

At present, waste electric wires are separated into copper and coating plastics such as polyethylene (PE), polypropylene (PP), or Polyvinyl Chloride (PVC) and recycled as industrial materials. However, the fine electric wires such as communication cables have not been recycled enough because of the insufficient development of separation technology.

FIG. 1 shows the 2002 statistics of electric wire production in Korea. As shown in FIG. 1, in 2002 the electric wire output and communication cable output in Korea were about 4 trillion won and 5 billion won in the value of production, respectively. Among them, waste electric wires and waste communication cables releases into the environment were about 500 billion won and 100 billion won in value.

If the separation efficiency is low in separating fine copper wires from plastic coatings, the coating plastics cannot be recycled and, therefore, a lot of money is required to completely separate the fine copper wires. The fine electric wires such as communication cables generally consist of copper and plastics such as PE, PP, PVC, etc. Each of them can be recycled after being separated into each material. A large amount of waste electric wires are annually generated from reconstruction and replacement of old communication cables, and due to increase in use of cars and electronic products. To recycle the waste electric wires, it is essential to develop the technologies to completely separate the copper wire and the coating plastics. The coating plastics may not be recycled if the metal such as copper are not removed thoroughly. Thus, the technology to completely remove the metal during a pre-process has to be developed inevitably.

The amount of the plastics used is increasing 10% yearly because of its excellent material properties. It is predicted that the plastics production will reach about 11 million tons within five years and the waste plastic releases into the environment will come up to about 5 million tons within five years. Enormous economic injury as well as environmental problems may be caused if the technology to recycle the coating plastics is not developed. The plastic separation technology will contribute for environmental protection, recycling of useful resources, plastic industry development, and economic development.

Electric wires consist of a conductor part and a coating part. The conductor part is generally made of copper or aluminum. The coating part consists of an insulator to insulate the conductor and an outer coating to protect the insulator and the conductor part from damage. Both the insulator and outer coating are made of PVC, PE, Rubber, etc. Thus, in order to remove copper from the coating of waste electric wires, the insulator and outer coating have to be separated from the conductor.

Several electrostatic separation systems to remove the copper from the plastic coating of waste electric wires have been developed. For example, Korean utility model 288589, Seo, describes an electrolytic electrostatic induction separation system. FIG. 2. is a schematic diagram of the electrolytic electrostatic induction separation system disclosed in the Seo utility model. The electrolytic electrostatic induction separation system includes an electrolyzer consisting of an NA belt (100) charged with negative and a stainless net (200) charged with positive, and a paper belt (300) for electrostatic induction, which moves vertically over the NA belt (100). The NA belt (100) is made of nitrile-butadiene rubber including XE2 (or active carbon dust) of 27~30%. In the Seo's separation system, the copper bits charged with negative by the NA belt (100) are electrostatic-induced and attracted to the paper belt (300) when the paper belt (300) moves vertically over the NA belt (100). The copper bits separated from the plastic coating bits are collected into a collection container (400) installed below the paper belt (300). The untreated residues are collected into another collection container (500) installed at the rear of the stainless net (200). The plastic coating bits are attached to the surface of the NA belt (100) and, then, collected into a coating collection container (600) by means of a scraper. However, in the Seo's separation system, the paper belt (300) must be replaced after being used for a predetermined period and the simple stainless net (200) structure is difficult to generate optimum electrostatic induction. In addition, the disposition structure of three collection containers fails to achieve complete separation of the plastic coating and copper. Particularly, the Seo's separation system fails to achieve high separation rate of the coating plastics because it passes over the influence of interrelation between positive and negative electrodes, such as the distance between the negative and positive electrodes, the width ratio of the negative electrode to the positive electrode, and the structure of the two electrodes, to the electrostatic induction.

As other examples of conventional separation system, FIG. 3 through FIG. 5 are schematic diagrams of the electrostatic separation devices according to the Korean Utility Model 232140, Jang (FIG. 3), Japanese publication patents JP2001-283661, Tetsuya et al. (FIG. 4), and JP1995-178351, Showa and Norihiro (FIG. 5). The electrostatic separation devices of FIG. 3 and FIG. 5 separate the coating plastics and the metal wire by charging sidewalls of a chamber so that they have an opposite polarity each other and making input materials free falling. These separation devices can separate large particles but is difficult to handle small particles less than 1 mm. In detail, the small particles may clings to the sidewalls by static electricity due to eddy currents which are occurred in the chamber because of the sidewalls with opposite polarity. The electrostatic separation device of FIG. 4 includes a rotating cylinder on which input materials are supplied and a separating container in which the metal wire and the coating plastics are collected separately. However, the separation device of FIG. 4 can accurately separate when the mixing ratio and supply of the input materials are constant. Moreover, the separation device of FIG. 4 cannot improve a selection rate because of the very simple electrode structure.

DISCLOSURE OF INVENTION

The present invention is directed to an electrostatic separation system that substantially obviates one or more problems due to limitations and disadvantages of the related art.

An object of the present invention is to provide an electrostatic separation system comprising a negative electrostatic induction plate and positive metal net made of special materials, which have appropriate dimensions and an appropriate space between them to improve separation efficiency, and a separating plate which is appropriately positioned to improve separation efficiency.

To achieve the object, the present invention provides an electrostatic separation system comprising a feeder which feeds input materials comprising cut plastic coating bits and metal bits on a negative electrostatic induction plate; the negative electrostatic induction plate to which negative electricity is applied, moving the input materials by means of vibration by a vibrator; a positive metal net to which positive electricity is applied, having a predetermined width equivalent to or larger than the negative electrostatic induction plate; and a separating plate appropriately positioned between the negative electrostatic induction plate and positive metal net, separating the input materials into metal bits and plastic coating bits.

BRIEF DESCRIPTION OF THE DRAWINGS

Further objects and advantages of the invention can be more fully understood from the following detailed description taken in conjunction with the accompanying drawings, in which:

FIG. 1 is a table of 2002 Korean electric wires production statistics.

FIG. 2. through FIG. 5 are schematic diagrams of conventional electrostatic separation systems.

FIG. 6 is an example of input materials fed into an electrostatic separation system in accordance with the present invention.

BEST MODE FOR CARRYING OUT THE INVENTION

Reference will now be made in detail to the preferred embodiments of the present invention, examples of which are illustrated in the accompanying drawings.

FIG. 6 is an example of input materials fed into an electrostatic separation system in accordance with the present invention. In an embodiment of the present invention, optical communication cables, which are cut into small bits less than 3 mm in length, are used as input materials. Generally, large plastics and metal bits in size can be easily separated by the electrostatic separation system because the large metal bit has a high specific gravity. However, in case of a fine metal wire such as communication cable, the small and fine metal cannot be separated by means of specific gravity selection because it has a large specific surface area. Thus, in the present invention, the communication cables are cut into less than 3 mm in length.

Figure 7:
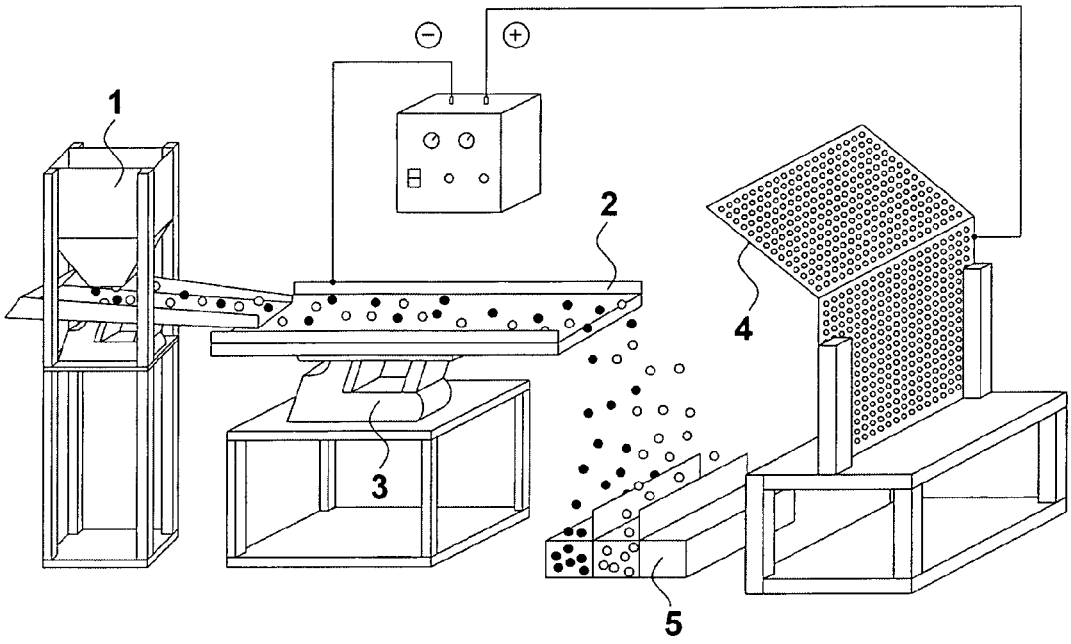
FIG. 7 is a schematic diagram of an electrostatic separation system in accordance with the present invention.

FIG. 7 is a schematic diagram of an electrostatic separation system in accordance with the present invention. A feeder (1) constantly feeds the input materials into a negative electrostatic induction plate (2) through which negative electricity flows. Then, the conductive metal materials in the input materials are charged with the same negative to the negative electrostatic induction plate (2) and move forward due to vibration by a vibrator (3) attached under the negative electrostatic induction plate (2). When the electrified conductive metal materials reach at the right end of the negative electrostatic induction plate (2) and fall down to the ground, a positive metal net 4 installed on the right side attracts the electrified conductive metal materials to separate the non-conductive coating plastics from the conductive metal materials.

The electrostatic induction separation system of the present invention comprises the new negative electrostatic induction plate (2) to effectively separate the fine metal wires. A conventional negative electrostatic induction plate has generally been made of metal with high electric conductivity. However, the negative electrostatic induction plate of the present invention is made of a conductive material with a larger work function than that of the metal such as copper or other metals to raise the electrostatic induction of the metal particles.

Figure 8:
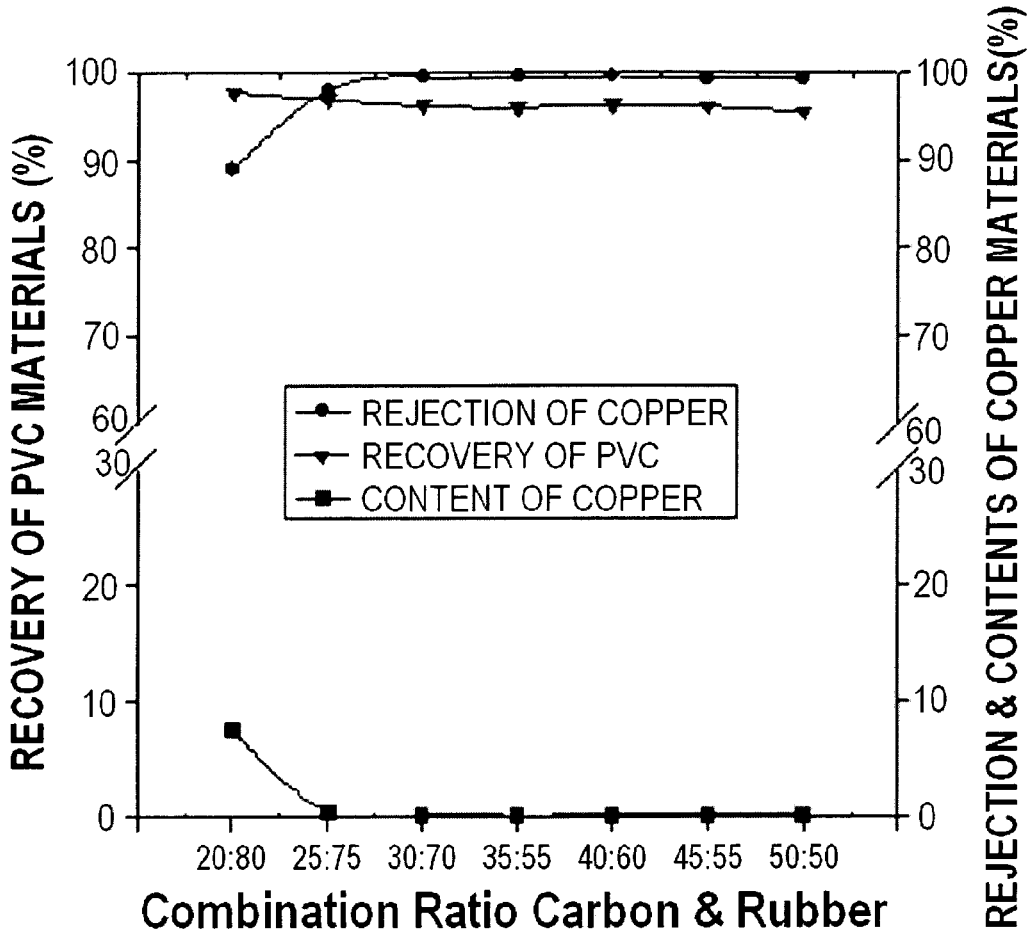
FIG. 8 is a graph illustrating separation efficiency change according to change in mixing ratio of materials constituting the negative electrostatic induction plate of an electrostatic separation system in accordance with the present invention.

FIG. 8 is a graph illustrating separation efficiency change according to change in mixing ratio of materials constituting the negative electrostatic induction plate of the electrostatic separation system in accordance with the present invention. The negative electrostatic induction plate (2) comprises high purity carbon and rubber. As shown in FIG. 8, starting from the mixing ratio of 25:75 (carbon: rubber), the separation rate begins to increase considerably. The negative electrostatic induction plate (2) provides high separation efficiency even though the mixing ratio is 50:50 (carbon: rubber). However, in that case, the rough surface of negative electrostatic induction plate (2) prevents the movement of input materials as well as manufacturing the electrostatic induction plate (2) is difficult. Therefore, the present invention excepts when the percentage of carbon is more than 50%. In another embodiment, instead of the carbon, another material such as copper, silver, or aluminum may be used to make the negative electrostatic induction plate (2).

By using larger negative and positive electrodes in width than conventional electrodes of electrostatic induction selection system, the electrostatic induction selection system according to the present invention may achieve high processing capacity more than 5 times compared with conventional electrostatic induction selection systems. In addition, by using the negative electrostatic induction plate (2) including a conductive fine material, the electrostatic induction separation system according to the present invention can separate fine particles of 0.1 mm.

Figure 9:
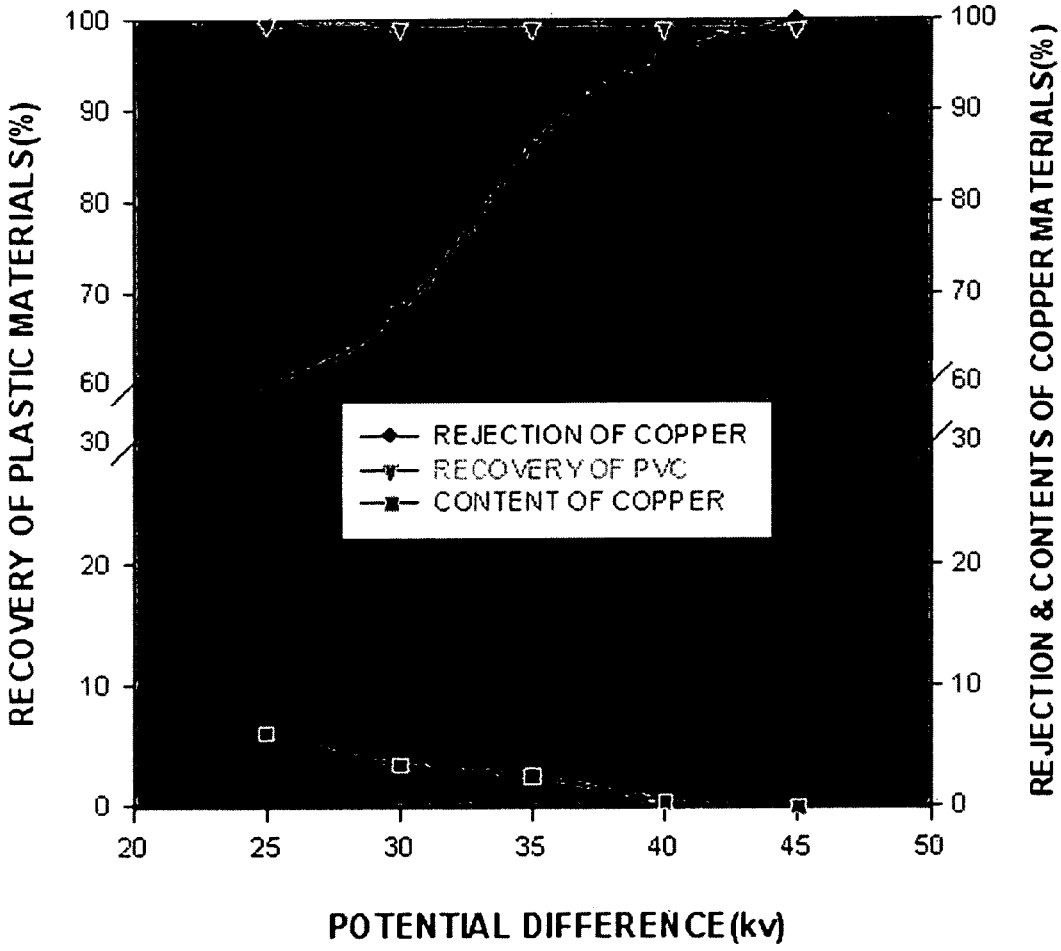
FIG. 9 is a graph illustrating separation efficiency change according to voltage change in an electrostatic separation system in accordance with the present invention.

FIG. 9 is a graph illustrating separation efficiency change according to voltage change in an electrostatic separation system in accordance with the present invention. The range of voltage experimented is between 25 kV and 45 kV. As shown in FIG. 9, the PVC collection rate is uninfluenced by the voltage strength but the metal collection rate, for example, copper collection rate, increases to more than 98% when the voltage is above 40 kV. In detail, the plastics collection rate is 99.5% at 25 kV and 98.9% at 45 kV to indicate 0.6% difference between them. The copper removal rate is 60% at 25 kV and 99.6% at 45 kV to indicate about 40% difference between them. Particularly, the copper removal rate is as high as 98.5 % when the applied voltage is 40 kV. Therefore, the present invention applies 40 kV as an optimum experimental voltage to the electrostatic induction separation system considering experimental safety and energy consumption. At this condition, the plastic collection rate is 98.9%, the copper removal rate is 98.5%, and the percentage of residual copper in the plastics is 0.4%.

On the other hand, the strength of electric current to be applied to the system relates to the capacity of the system. If the current strength is very high, it will not influence the experiment efficiency but may threaten the workers' safety. Therefore, the present invention uses the electric current as low as possible within the current range that does not influence the separation efficiency. FIG. 9 shows the separation efficiency change according to the voltage change when the applied electric current is 0.1 A. The preferable range of electric current is between 0.05 A and 2 A.

Figure 10:
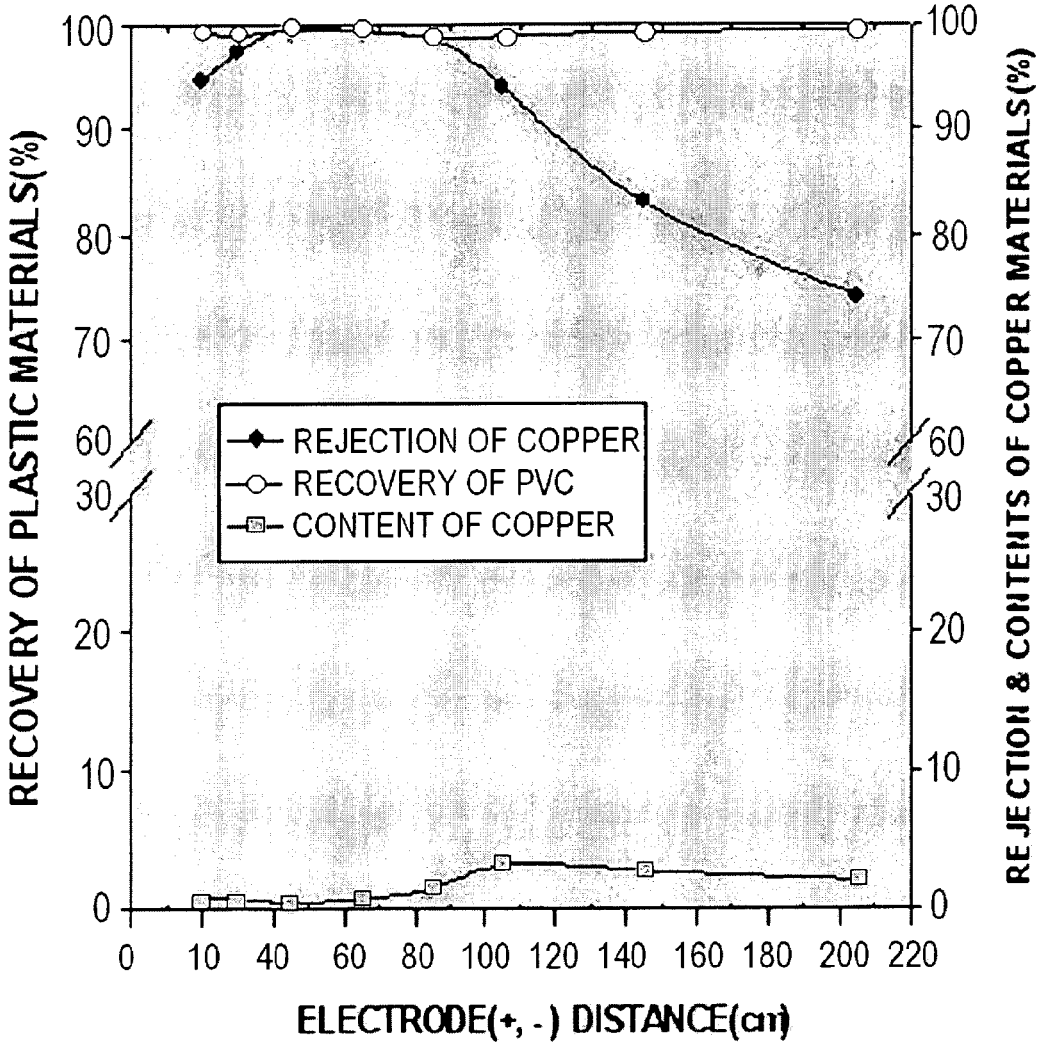
FIG. 10 is a graph illustrating separation efficiency change according to the change of distance between a negative electrostatic induction plate and a positive metal net of an electrostatic separation system in accordance with the present invention.

FIG. 10 is a graph illustrating separation efficiency change according to the change in the distance between the negative electrostatic induction plate and the positive metal net. As shown in FIG. 10, when the distance between the negative electrostatic induction plate (2) and the positive metal net (4) varies from 20 cm to 205 cm, the plastics collection rate and the metal removal rate also undergo considerable changes. The reason why the distance between the negative electrostatic induction plate (2) and the positive metal net (4) influences the selection efficiency is that the energy to attract the electrified conductive particles and the electric field formed between the two electrodes become different according to the distance between the two electrodes.

As shown in FIG. 10, the distance between the negative electrostatic induction plate (2) and the positive metal net (4) hardly influences the plastic collection rate. It is because the coating plastics are nonconductors. In other words, the nonconductive plastics are not electrified by the negative electrostatic induction plate (4) and, therefore, move toward the end of the negative electrostatic induction plate (2) by a vibrator (3) installed under the negative electrostatic induction plate (2) and fall down to be collected. However, the removal rate of the conductive metal wires varies according to the change of distance between the two electrodes. For example, when the distance between the negative electrostatic induction plate (2) and the positive metal net (4) is 40 cm and 60 cm, the copper collection rate is 99.8% and 99.5%, respectively. If the distance between the two electrodes is shorter than 40 cm or longer than 60 cm, the copper removal rate considerably reduces as shown in FIG. 10. In detail, if the distance between the negative electrostatic induction plate (2) and the positive metal net (4) is shorter than 40 cm, the copper is not easily removed because the electric field formed between the two electrodes has a bad influence such as interference by eddy currents upon the selection. If the distance between the negative electrostatic induction plate (2) and the positive metal net (4) is longer than 60 cm, the copper is not easily removed because the positive metal net (4) cannot attract the electrified conductive particles due to the long distance from the negative electrostatic induction plate (2) although a good electric field is formed so that the positive metal net (4) can attract the electrified conductive particles. Thus, in the present invention, the distance between the negative electrostatic induction plate (2) and the positive metal net (4) is preferably 50 cm considering the plastics collection rate and copper removal rate. In this case, the plastics collection rate and copper removal rate are 99.5% and 99.6% respectively.

The copper particles electrified by the negative electrostatic induction plate (2) are moved toward the end of the negative electrostatic induction plate (2) by the vibrator (3) and fall down. Then, the positive metal net (4) attracts the falling copper particles to separate them from the nonconductive plastics. Here, the nonconductive plastics fall down just below the end of the negative electrostatic induction plate (2) because the plastics are not electrostatic-induced. However, the copper particles fall down apart from the negative electrostatic induction plate (2) because the positive metal net (4) attracts the electrified copper particles. Accordingly, the separation efficiency may be considerably increased if a separating plate (5) is placed between the places on which the plastics and the copper particles fall down separately.

Figure 11:
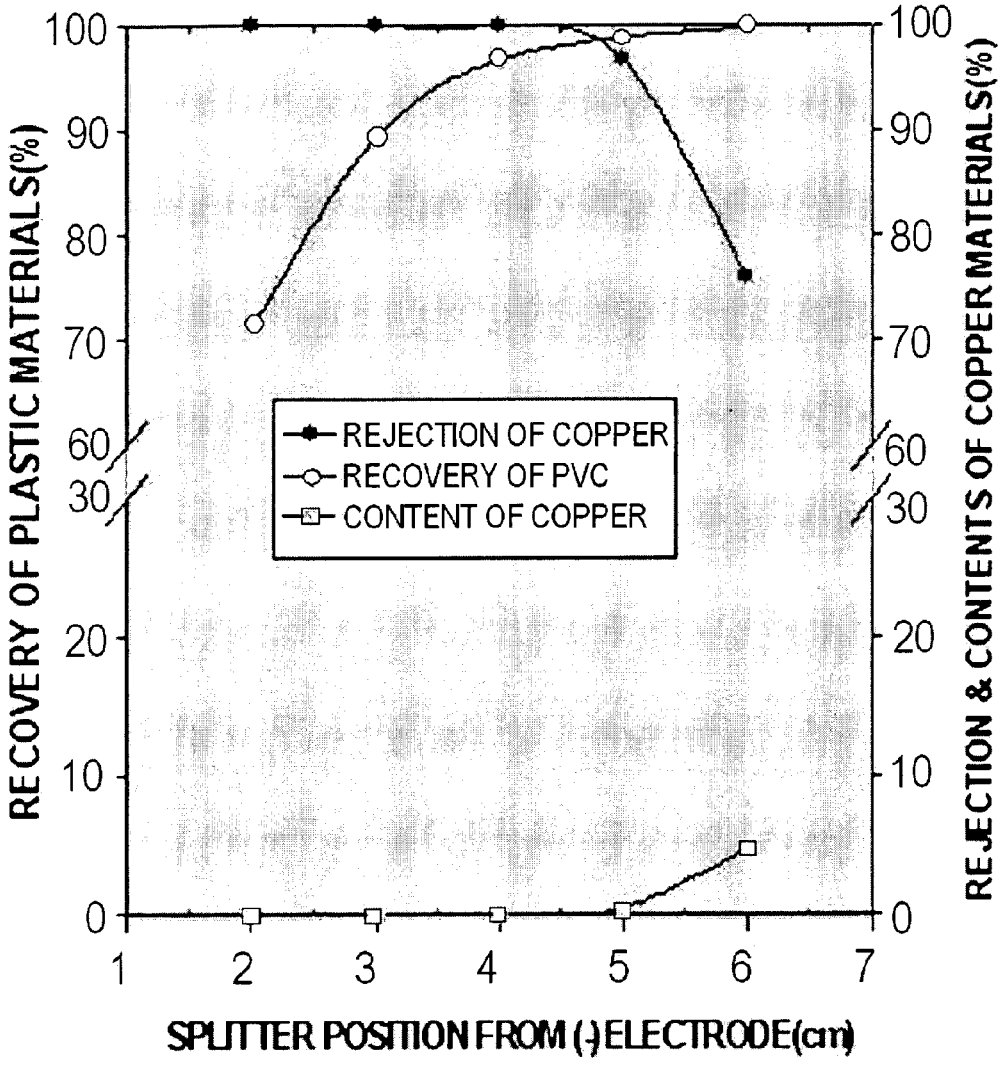
FIG. 11 is a graph illustrating separation efficiency change according to the change of horizontal distance between a negative electrostatic induction plate and a separating plate of an electrostatic separation system in accordance with the present invention.

FIG. 11 is a graph illustrating separation efficiency change according to change in the horizontal distance between the negative electrostatic induction plate and the separating plate of the electrostatic separation system in, accordance with the present invention. As shown in FIG. 11, if the separating plate (5) approaches the negative electrostatic induction plate (2), the plastics collection rate decreases but the copper removal rate increases. On the contrary, if the separating plate (5) approaches the positive metal net (4), the copper removal rate decreases but the plastics collection rate increases.

In detail, if the separating plate (5) gets near to the negative electrostatic induction plate (2), relatively pure plastics can be collected because the area for collecting plastics is small, but some plastics may be contained in the copper collected on the other side. Contrarily, if the separating plate (5) gets away from the negative electrostatic induction plate (2), plastics collection rate increases because the area for collecting plastics is large, but some copper particles may be contained in the plastics collected.

In accordance with the present invention, the plastics collection rate and the copper removal rate reach a maximum when the horizontal distance between the negative electrostatic induction plate (2) and the separating plate (5) is 4 cm. In this case, the plastics collection rate and the copper removal rate is 96.8% and 99.8% respectively.

Figure 12:
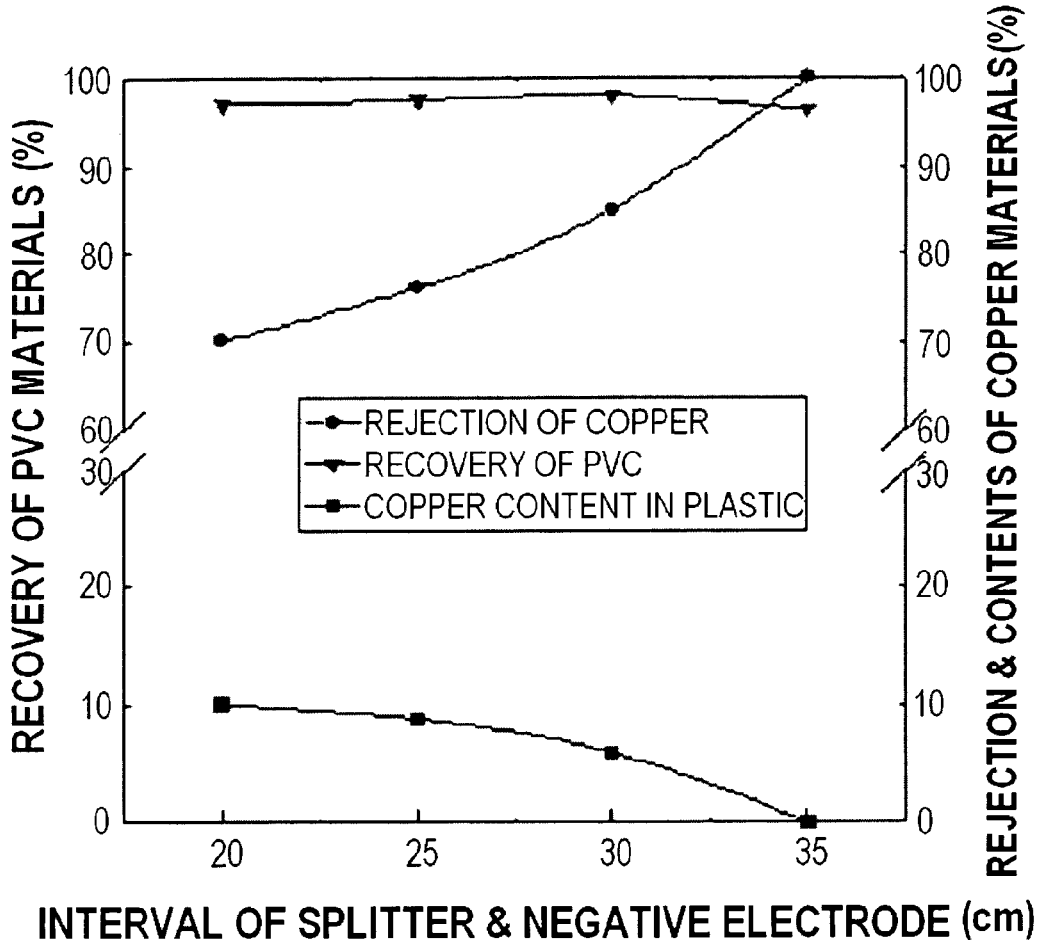
FIG. 12 is a graph illustrating separation efficiency change according to the change of vertical distance between a negative electrostatic induction plate and a separating plate of an electrostatic separation system in accordance with the present invention.

FIG. 12 is a graph illustrating separation efficiency change according to change in the vertical distance between the negative electrostatic induction plate and the separating plate of the electrostatic separation system in accordance with the present invention. In FIG. 12, the horizontal distance between the negative electrostatic induction plate (2) and the separating plate (5) is fixed on the optimum distance, 4 cml, and the vertical distance between them ranges from 20 cm to 35 cm. According to the outcome of experiment, the vertical distance does not influence the plastics collection rate. However, the copper removal rate decreases when the vertical distance is short and increases when the vertical distance is long. In detail, when the vertical distance is 20 cm and 35 cm, the plastics collection rate is 97.1% and 96.4% respectively. However, the copper removal rate is 70.1% and 99.8% respectively when the vertical distance is 20 cm and 35 cm. Accordingly, the long vertical distance between the negative electrostatic induction plate (2) and the separating plate (5) is effective for separation efficiency. The reason why the vertical distance greatly influences the copper removal rate is that the space and time for the positive metal net (4) to attract the electrified copper particles decrease if the vertical distance is short, and the space and time for the positive metal net (4) to attract the electrified copper particles increase if the vertical distance is long.

Figure 13:
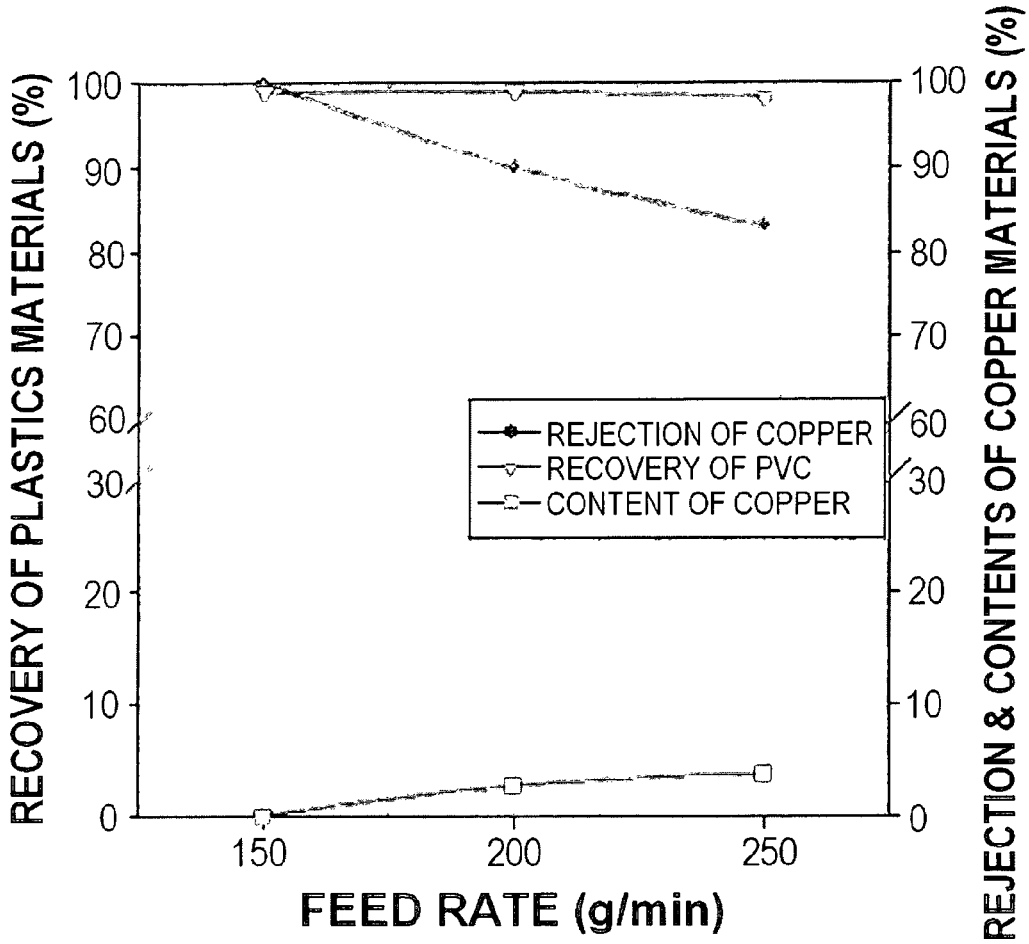
FIG. 13 is a graph illustrating separation efficiency change according to change in the feed rate of input materials fed into a negative electrostatic induction plate of an electrostatic separation system in accordance with the present invention.

FIG. 13 is a graph illustrating separation efficiency change according to change in the feed rate of input materials fed into the negative electrostatic induction plate of the electrostatic separation system. According to the outcome of experiment, the plastics collection rate is uninfluenced by the feed rate of input materials. The copper removal rate is 99.8% and 99.7% respectively when the input materials are fed at the rate of 100 g/min and 200 g/min. However, the copper removal rate decreases if the rate is higher than the 200 g/min. For example, the copper removal rate is reduced to 83.2% when the rate is 250 g/min. Thus, in the present invention, the feed rate of input materials is preferably 150 g/min considering the optimum processing capacity of system. In this case, the plastics collection rate and the copper removal rate is 98.9% and 99.7% respectively.

Figure 14:
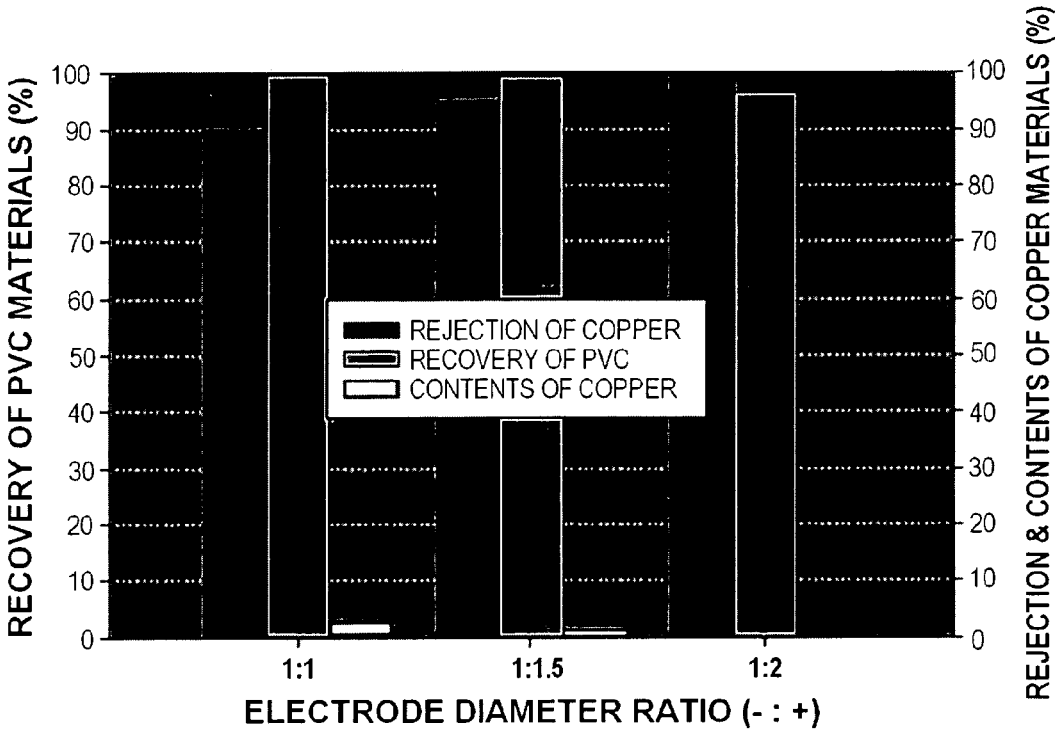
FIG. 14 is a graph illustrating separation efficiency change according to change in ratio of the width of negative electrostatic induction plate to width of positive metal net of an electrostatic separation system in accordance with the present invention.

FIG. 14 is a graph illustrating separation efficiency change according to change in ratio of the width of negative electrostatic induction plate to the width of positive metal net. Here, the positive metal net (4) is screen-type and made of stainless steel. According to the outcome of experiment, when the width ratio of the negative electrostatic induction plate (2) to the positive metal net (4) is 1 to 1, the plastics collection rate is 99.6% but the copper removal rate is 90.1%. The copper removal rate increases if the width ratio of the negative electrostatic induction plate (2) to the positive metal net (4) decreases. For example, when the width ratio is 1 to 1.5 and 1 to 2.5, the copper removal rate is 95.2% and 99.8% respectively. In conclusion, the width of the negative electrostatic induction plate (2) and the positive metal net (4) may greatly influence separation efficiency. In removing the conductive copper particles from the coating plastics, the positive metal net (4) has to be larger about 2 times in width than the negative electrostatic induction plate (2) to achieve high separation efficiency. This is because the electric field formed between the negative electrostatic induction plate (2) and the positive metal net (4) becomes different according to the change in the width of the positive metal net (4). In other words, if the positive metal net (4) is wider than the negative electrostatic induction plate (2), a denser electric field is formed for the electrified metal particles so that the positive metal net (4) attracts the electrified metal particles more forcefully.

Figure 15:
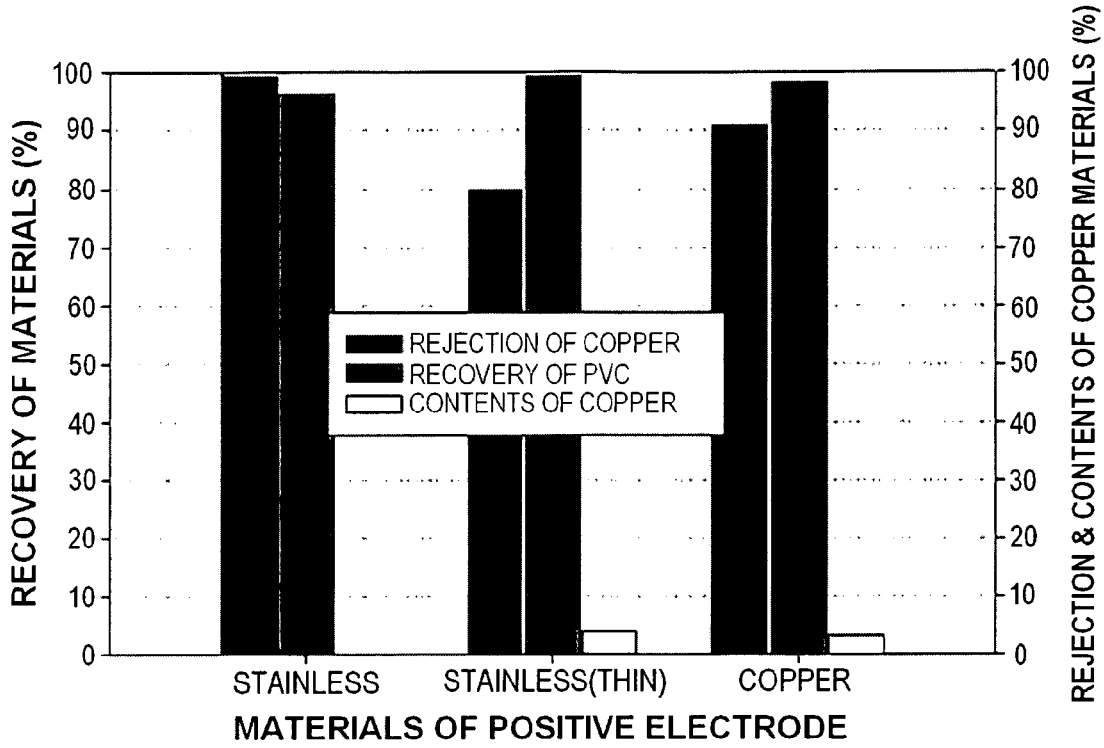
FIG. 15 is a graph illustrating separation efficiency according to the material used in the manufacture of positive metal net of an electrostatic induction separation system in accordance with the present invention.

FIG. 15 is a graph illustrating separation efficiency according to a material used in the manufacture of positive metal net. FIG. 15 shows the outcome of experiment for stainless steel and copper. Technically, the positive metal net made of copper may be better than the positive metal net made of stainless steel because the conductivity of copper is higher than that of stainless steel. However, according to the outcome of experiment, the copper removal rate of the stainless steel net is higher by 4% than that of the copper net. Therefore, the stainless steel is better as a material to manufacture the positive metal net than the copper.

Figure 16:
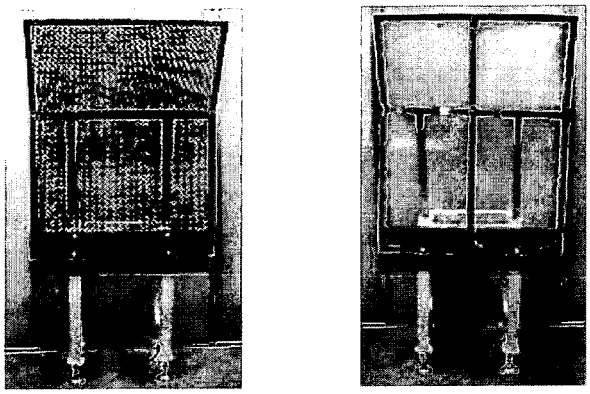
FIG. 16 shows pictures of the positive metal net of an electrostatic induction separation system in accordance with the present invention.

FIG. 16 shows pictures of the positive metal net of the electrostatic induction separation system in accordance with the present invention. As shown in FIG. 16, the positive metal net with an appropriate height is installed on a support so that an electric field to effectively attract falling metal particles can be formed. As described above, it is effective that the positive metal net (4) is made of stainless steel. At the optimum experimental conditions, the plastics collection rate and copper removal rate are 96.3% and 99.8% respectively when the positive metal net (4) made of stainless steel is used.

Particularly, as shown in FIG. 7, the middle part of the positive metal net (4) is bent at a predetermined angle toward the negative electrostatic induction plate (2). According to the outcome of experiment of present invention, the selection efficiency is very high when the angle is between 35° and 45°. The selection efficiency is maximum when the angle is 40°. The datum line for the angle of bend is the vertical lower part of the positive metal net (4). Particularly, regarding the height of the positive metal net (4), high selection efficiency is achieved when the bend part of the positive metal net (4) is positioned at the same level with the negative electrostatic induction plate (2).

Figure 17:
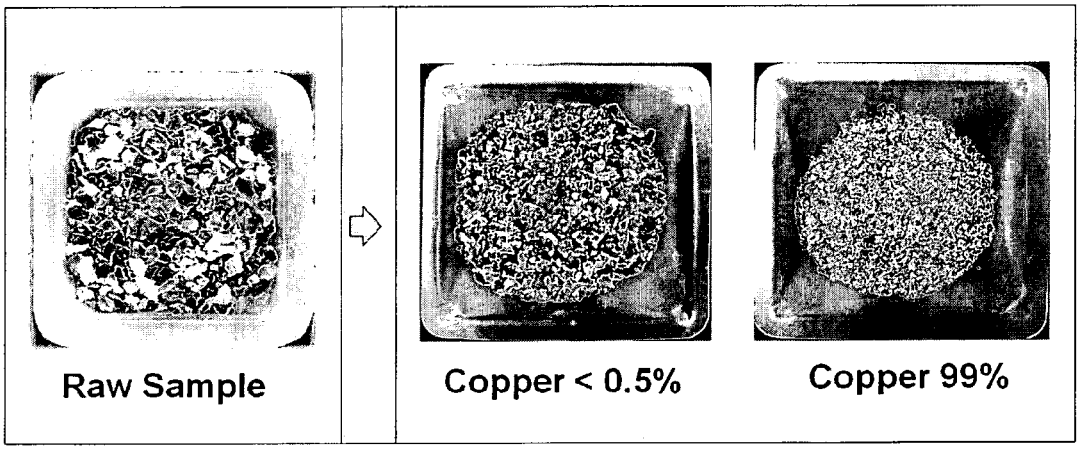
FIG. 17 and FIG. 18 are examples of products obtained by using an electrostatic induction separation system in accordance with the present invention.
Figure 18:
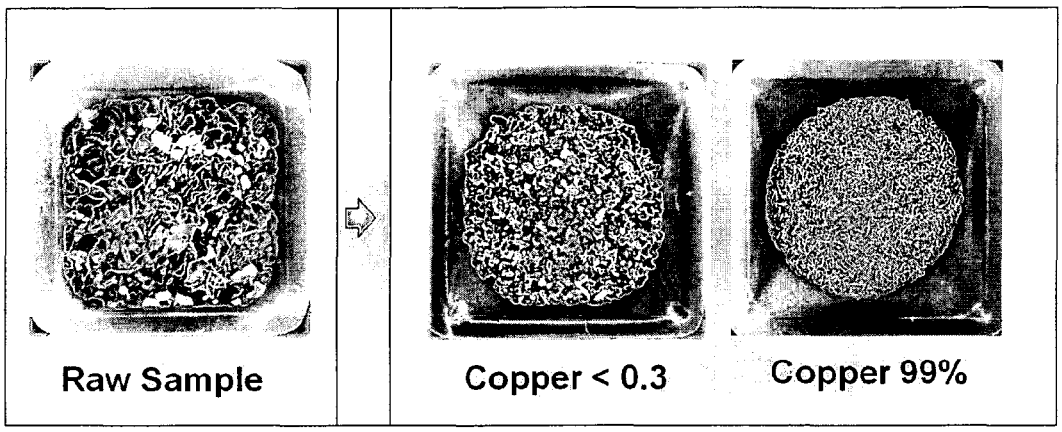

FIG. 17 and FIG. 18 are examples of products obtained by using the electrostatic induction separation system in accordance with the present invention. FIG. 17 shows the cut waste communication cables with 3 mm thickness and coating plastics and copper which are produced by separating the plastic coating from the cut waste communication cables. FIG. 18 shows raw material and products for comparison to examine the influence of the copper particle shape on the electrostatic selection efficiency.

According to the above-described output of experiment, the optimum conditions and preferable ranges are summed up as follow. The optimum voltage is 40 kV and the preferable voltage range is 25 kV to 45 kV. The optimum distance between the negative electrostatic induction plate (2) and the positive metal net (4) is 50 cm and the preferable range of the same is 40 cm to 60 cm. The optimum horizontal distance between the negative electrostatic induction plate (2) and the separating plate (5) is 4 cm and the preferable range of the same is 3 cm to 5 cm. At the point of the optimum horizontal distance 4 cm between the negative electrostatic induction plate (2) and the separating plate (5), the optimum vertical distance between the negative electrostatic induction plate (2) and the separating plate (5) is 35 cm and the preferable range of the same is 30 cm to 50 cm. The optimum feed rate of input material is 150 g/min and the preferable range of the same is 100 g/min to 250 g/min. The optimum ratio of the width of the negative electrostatic induction plate (2) to that of the positive metal net (4) is 1 to 2 and preferable ratio of the same is between 1 to 1 and 1 to 2. The positive metal net is preferably made of stainless steel. The optimum angle at which the middle part of the positive metal net (4) is bent toward the negative electrostatic induction plate (2) is 40° and the preferable range of the same is 35° to 45°. The bend part of the positive metal net (4) has to be positioned at the same level with the horizontal surface of the negative electrostatic plate (2). In the above-described optimum conditions, the coating plastics collection rate and the copper removal rate are 97% and 99% respectively.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

INDUSTRIAL APPLICABILITY

Accordingly, by presenting optimum conditions for voltage, the distance between the negative electrostatic induction plate and the positive metal net, the ratio of width of negative electrostatic induction plate to that of positive metal net, the distance between the negative electrostatic induction plate and the separating plate, the feed rate of input material, the materials used in the manufacture of the negative electrostatic induction plate and the positive metal net, the height of the positive metal net, and the bend angle of the positive metal net, the electrostatic separation system according to the present invention has processing capacity more than 5 times in comparison to conventional electrostatic selection systems and is able to separate fine particles of 0.1 mm in size. In addition, the electrostatic separation system has wide application in recycling other useful recourses as well as separating the mixture of fine particle metal and non-metal materials.

What is claimed is:

1. An electrostatic separation system for separating fine metal and plastics, comprising:

a feeder feeding input materials comprising conductive materials and nonconductive materials into a negative electrostatic induction plate;

the negative electrostatic induction plate to which negative electricity is applied, the negative electrostatic induction plate moving the input materials by using a vibrator, the vibrator being installed under the negative electrostatic induction plate;

a positive metal net to which positive electricity is applied, the positive metal net having a width equivalent to or larger than the negative electrostatic induction plate; and a separating plate positioned between the negative electrostatic induction plate and positive metal net, the separating plate separating the input materials into conductive materials and nonconductive materials, wherein the input materials having less than 0.1 mm in size are supplied at a feed rate of 150 g/min, and 40 kv is applied to the negative electrostatic induction plate and the positive metal net, and the vertical distance between the negative electrostatic induction plate and the positive metal net is 50 cm.

2. The system as defined by claim 1, wherein the positive metal net is bent at its middle part toward the negative electrostatic induction plate wherein the bend part is positioned at the same level with the negative electrostatic induction plate.

3. The system as defined by claim 1, wherein the negative electrostatic induction plate comprises carbon of 25% to 50%.

4. The system as defined by claim 1, wherein the positive metal net is made of stainless steel.

5. The system as defined by claim 1, wherein the positive metal net has a width equivalent to or larger than the negative electrostatic induction plate.

6. The system as defined by claim 1, wherein the angle at which the middle part of the positive metal net is bent is between 35° and 45°.

7. The system as defined by claim 1, wherein the horizontal distance between the negative electrostatic induction plate and the positive metal net is 3 cm to 5 cm.

* * * * *